United States Patent [19]

Stewart et al.

[11] 4,071,877

[45] Jan. 31, 1978

[54] DRIVE CIRCUIT

[75] Inventors: John W. Stewart; Ronald L. Bruckner, both of Wichita, Kans.

[73] Assignee: NCR Corporation, Dayton, Ohio

[21] Appl. No.: 627,736

[22] Filed: Oct. 31, 1975

[51] Int. Cl.[2] ..... H01H 47/32

[52] U.S. Cl. ..... 361/152; 361/153

[58] Field of Search ..... 317/DIG. 4, DIG. 6, 317/31, 137; 361/152, 153

[56] References Cited

U.S. PATENT DOCUMENTS

| | | | |
|---|---|---|---|
| 3,206,651 | 9/1965 | Proulx | 317/DIG. 4 |
| 3,628,100 | 12/1971 | Zettler | 317/DIG. 4 |
| 3,748,537 | 7/1973 | Vigini | 317/31 |

*Primary Examiner*—Harry E. Moose, Jr.
*Attorney, Agent, or Firm*—J. T. Cavender; Albert L. Sessler, Jr.

[57] ABSTRACT

A circuit provides means for driving a load under control of a plurality of signals including a drive timing signal which is given a maximum permissible duration by the circuit to prevent damage to the load, an operating signal, and an inhibit signal which prevents operation in case of excessively low power supply voltage. A power supply of opposite polarity is connected to the load so that the load rapidly dissipates its energy into said power supply at the time of turn-off of the drive circuit.

17 Claims, 5 Drawing Figures

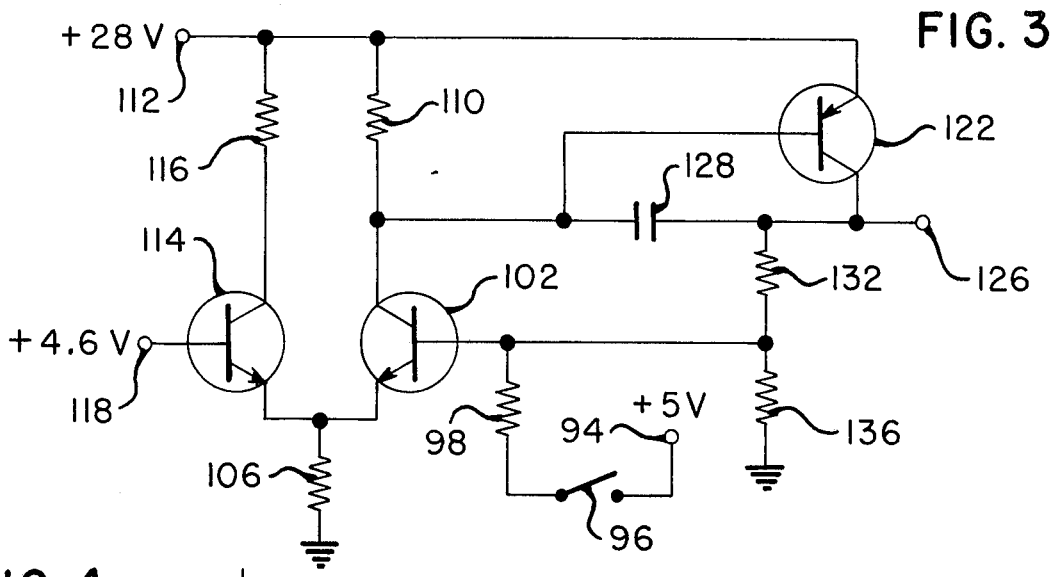
FIG. 3
FIG. 4
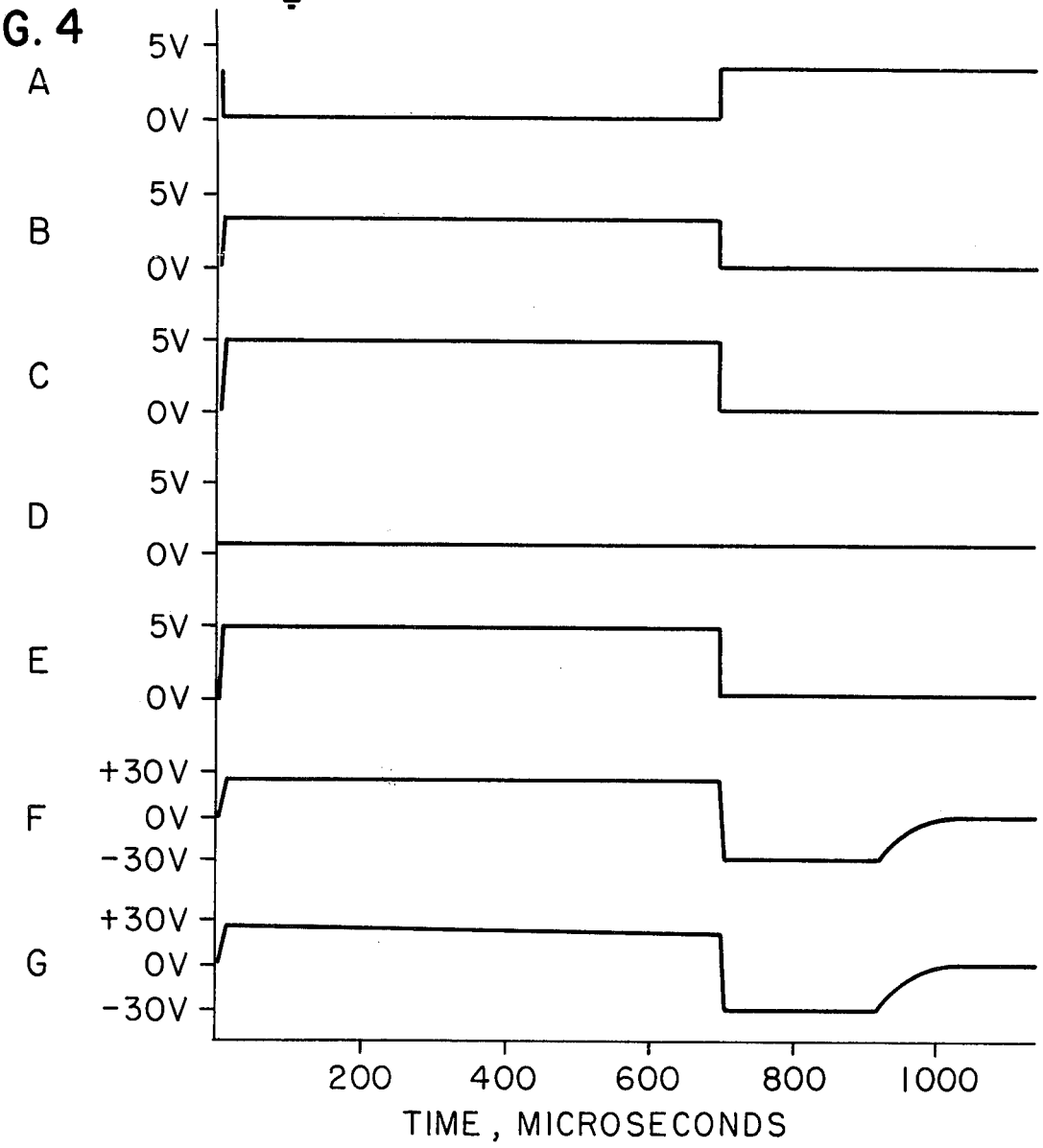

DRIVE CIRCUIT

BACKGROUND OF THE INVENTION

In the field of high-speed printing devices which are especially suitable for use in connection with electronic business systems, the wire matrix type of printer has come into increasing use. In this type of printer, letters, numbers and symbols are formed from a series of dots produced by the impact of the ends of a plurality of wire elements on record media, most customarily in combination with an ink ribbon which provides the ink needed to produce a mark on the record medium being printed upon.

Customarily each of the individual wire printing elements of a wire matrix printer is driven by a solenoid which is energized when a printing stroke of that wire is required. A need thus exists for a solenoid driving circuit capable of driving a solenoid at a specified time in response to a print data signal, nd including means enabling rapid recovery of the solenoid from a printing stroke in preparation for the next stroke, as well as various other means to protect the solenoid against damage from overheating by energization for an excessive period of time, possible malfunction of the circuit from undetected variations in the power supply voltage level, and control of radiated interference from the circuit.

SUMMARY OF THE INVENTION

The purpose of the present invention is to provide an effective drive circuit for solenoid energization.

According to one embodiment of the invention, an operating circuit comprises a plurality of individual solenoid driver circuits for controlling the energization of solenoids; drive timing input means to which a drive timing signal may be applied; means for coupling the drive timing input means to each of the plurality of individual solenoid driver circuits, said coupling means including means for limiting the time of energization of the solenoids; data input means associated with each solenoid driver circuit to which a data signal may be applied; and inhibit means associated with each solenoid driver circuit and capable of inhibiting the operation of said circuit in response to a predetermined variation in the supply voltage for the coupling means; whereby an individual solenoid driver circuit to which a data signal is applied may be operated at a time and for a duration determined by a drive timing signal so long as the supply voltage for the coupling means is within acceptable limits.

One advantage of the present invention is that the drive circuit combines three input signals (drive timing, data and inhibit) which control solenoid energization.

Another advantage is that the drive circuit provides controlled dv/dt switch transitions, to control radiated interferences.

A further advantage is that the drive circuit provides high noise immunity on input print data lines.

An additional advantage is that the drive circuit operates an output transistor at a low power level such that heat sinking is not required.

Another advantage is that the drive circuit protects the print head solenoids from timing circuit failures and continuous operate commands.

A further advantage is that the drive circuit provides solenoid and driver protection for open connections in wiring harness or printed circuit board edge connectors.

It is therefore an object of the present invention to provide an improved solenoid drive circuit.

An additional object is to provide a solenoid drive circuit capable of combining a plurality of input signals to control the energization of a solenoid.

A further object is to provide a solenoid drive circuit capable of protecting a print head solenoid from timing circuit failures and continuous operate commands.

With these and other objects, which will become apparent from the following description, in view, the invention includes certain novel features of construction and combinations of parts, one form or embodiment of which is hereinafter described with reference to the drawing which accompanies and forms a part of this specification.

BRIEF DESCRIPTION OF THE DRAWING

FIG. 3 is a schematic diagram of an inhibit circuit.

FIG. 4 shows a plurality of wave forms illustrating voltage-time relationships at selected points in the circuitry of the present invention.

DESCRIPTION OF THE PREFERRED EMBODIMENT

Figure 1:
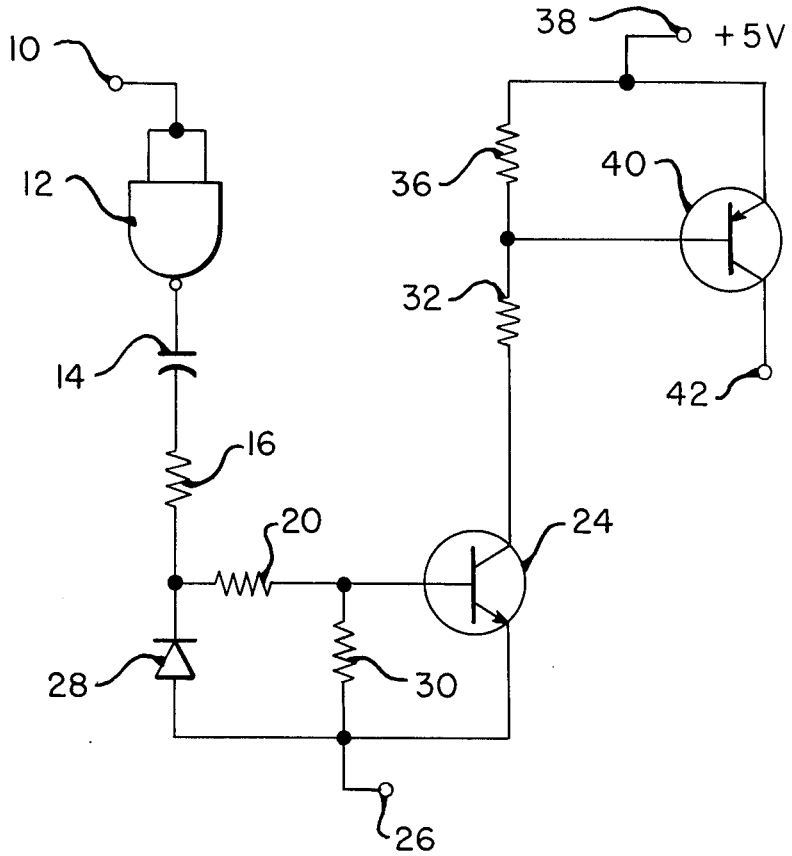
FIG. 1 is a schematic diagram of a coupling circuit.
Figure 2:
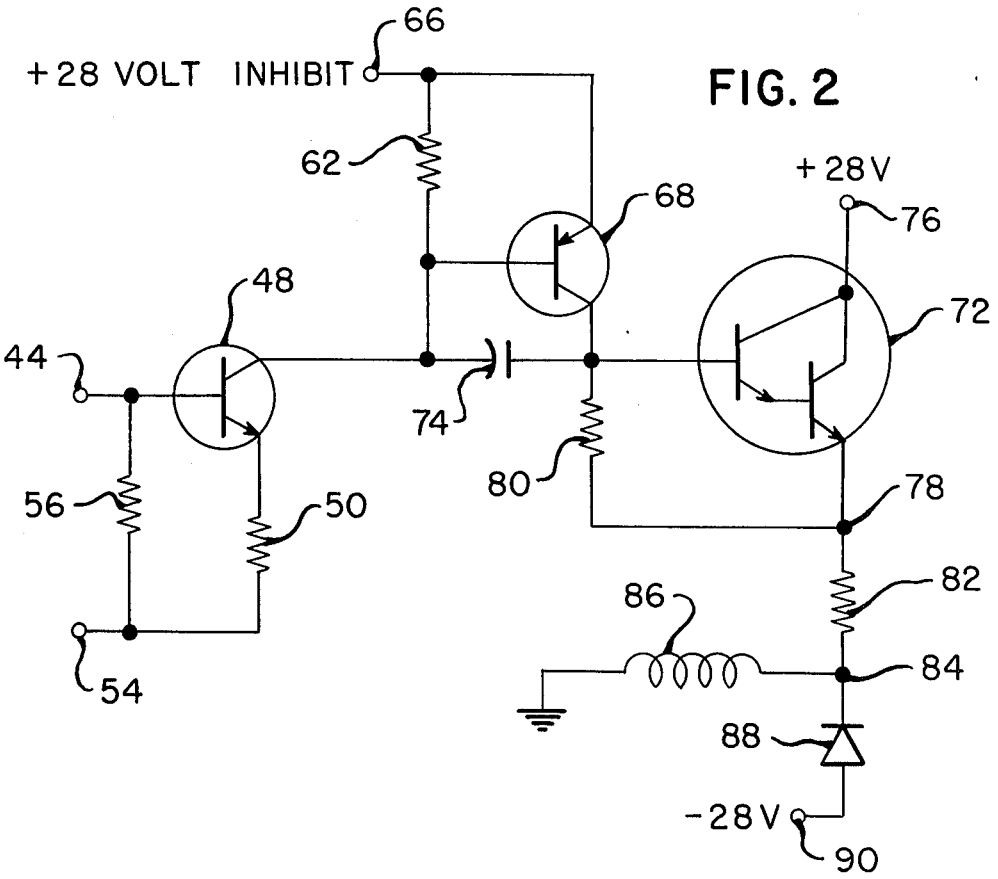
FIG. 2 is a schematic diagram of an individual solenoid driver circuit.

Referring now to the illustrated embodiment of the print head solenoid drive circuit shown in FIGS. 1, 2, 3 and 5, this circuit may be considered to be divided into three parts. In FIG. 1 is a coupling circuit which interfaces circuitry (not shown) for providing a drive timing signal, with individual solenoid driver circuits, one of which is shown in FIG. 2. An individual solenoid driver circuit is provided for each solenoid of a wire matrix print head. An inhibit circuit, shown in FIG. 3, is capable of controlling the individual driver circuits of FIG. 2 in accordance with whether or not the supply voltage for the coupling circuit and the digital logic which controls the operation of the circuit remains above a predetermined minimum level.

An input terminal 10 of FIG. 1 is connected to both inputs of a NAND gate 12, so that the gate 12 functions as an inverter. The output of the NAND gate 12 is connected to the base of an NPN-type transistor 24 through series-connected capacitor 14 and resistors 16 and 20. The emitter of the transistor 24 is connected to a logic ground terminal 26, as is the base of the transistor 24 through a resistor 30, and as is the junction of resistors 16 and 20 through a diode 28.

The collector of the transistor 24 is connected through series connected resistors 32, 36 to a terminal 38, to which is applied a +5-volt source of supply. Also connected to the +5-volt source of supply at terminal 38 is the emitter of a PNP-type transistor 40, the base of which is connected to the junction of the resistors 32 and 36, and the collector of which is connected to an output terminal 42.

The output signal appearing on terminal 42 of FIG. 1 is applied to an input terminal 44 of each of the individual solenoid drive circuits, one of which is shown in FIG. 2. The input terminal 44 is connected to the base of an NPN-type transistor 48. The emitter of the transistor 48 is connected through a resistor 50 to a second input terminal 54, to which a print data signal may be applied. A resistor 56 is connected between the terminals 44 and 54.

The collector of the transistor 48 is connected through a resistor 62 to a terminal 66, to which is connected a +28-volt inhibit line, to be subsequently described in greater detail. A PNP-type transistor 68 has its base connected to the collector of the transistor 48, its emitter connected to the terminal 66, and its collector connected to the base of a first transistor of a Darlington device 72. A capacitor 74 is connected between the collector and base of the transistor 68.

The collectors of the two transistors comprising the Darlington device 72 are coupled together and connected to a terminal 76, which is connected to a +28-volt power supply. The emitter of the first transistor of the Darlington device is connected to the base of the second transistor, and the emitter of the second transistor is connected to a resistor 82. A resistor 80 is connected between the collector of the transistor 68 and the emitter of the second transistor of the Darlington device 72.

From the emitter of the second transistor of the Darlington device 72, a solenoid energizing path extends through the resistor 82 and a solenoid 86 to a base reference potential, shown in FIG. 2 as ground. From the junction of the resistor 82 and the solenoid 86, a second path extends through a diode 88 to a terminal 90, which may be connected to a power supply of opposite polarity to the power supply applied to terminal 76, and indicated in the illustrated embodiment of FIG. 2 as being a −28-volt power supply.

Shown in FIG. 3 is an inhibit circuit, the purpose of which, as previously indicated, is to prevent operation of the individual solenoid driver circuits in FIG. 2 in the event that the +5-volt logic power supply drops below acceptable limits, which could result in erroneous operation of the circuitry of the present invention or associated circuitry which uses the +5-volt logic power supply. An input terminal 94 in FIG. 3 is connected to the +5-volt logic supply. A path extends from said terminal through a switch 96 (which may be controlled for any suitable purpose, such as a safety switch to disable printer operation in the event of opening a door or panel of the utilizing device) and a resistor 98 to the base of an NPN-type transistor 102. The emitter of the transistor 102 is connected through a resistor 106 to the logic base reference potential, or ground, while the collector of the transistor 102 is connected through a resistor 110 to a terminal 112, to which is connected the +28-volt power supply. Also connected to the resistor 106 is the emitter of a second NPN-type transistor 114 having its collector connected through a resistor 116 to the terminal 112, and having its base connected to a terminal 118, to which is applied a reference bias potential of +4.6 volts.

From the collector of the transistor 102, a circuit path extends to the base of a PNP-type transistor 122, having its emitter connected to the +28-volt power supply at terminal 112, and having its collector connected to an inhibit output terminal 126. From the collector of the transistor 102, a further circuit path extends through a capacitor 128 to the collector of the transistor 122, from which a circuit path also extends through a resistor 132 and a resistor 136 to the logic base reference potential, or ground. An additional circuit path connects the base of the transistor 102 to the junction of the resistors 132 and 136.

The operation of the circuit of the present invention, shown generally in FIG. 5, will now be described.

The drive timing signal which is applied to the input terminal 10 of FIG. 1 is shown in FIG. 4A and will be taken from logic circuitry associated with, or forming a part of, the wire matrix printer in which the illustrated embodiment of the present invention is utilized. One circuit for generating a drive timing circuit suitable for use with the present circuit is disclosed in the copending U.S. application Ser. No. 614,808, filed Sept. 19, 1975, inventor John W. Stewart, entitled "Voltage Compensated Timing Circuit", assigned to the assignee of the present application, now U.S. Pat. No. 4,015,842, issued Mar. 29, 1977.

When a low level signal is applied to the terminal 10, and thereby to the inputs of the NAND gate 12, the output of said gate is driven to a high level, as shown in FIG. 4B. Application of this signal through the capacitor 14 and the resistors 16 and 20 to the base of the transistor 24 causes said transistor to commence conducting. The base current of the transistor 24 and the current in the resistor 30 act to charge the capacitor 14 from the logic reference or ground terminal 26, so that if the input signal at the terminal 10 remains low for more than ten milliseconds, the capacitor 14 will be sufficiently charged that the transistor 24 will turn off, thus terminating energization of the solenoid 86 in FIG. 2. This protects the solenoid against damage from overheating caused by energization of excessive duration. Normal drive timing pulses are of approximately 700 microseconds duration, and are not affected by this feature. The diode 28 and the resistor 16 are the significant components in the discharge path for the capacitor 14 which discharges during the normal off time of 250 microseconds.

Application of the input signal to the base of the transistor 24 causes said transistor to commence conducting, thereby lowering the potential on its collector, which causes the potential on the base of the transistor 40 to drop, thus initiating conduction of that PNP transistor.

Conduction of the transistor 40 causes the signal at the terminal 42 connected to the collector of said transistor to rise to a high level, as shown in FIG. 4C, nearly to the +5-volt level of the power supply at the terminal 38. When the transistor 40 is non-conducting, the level of the signal at terminal 42 will be either at close to zero volts, or floating, depending upon whether or not one or more print data signals are being applied to the various drive circuits of FIG. 2, as will subsequently be described in greater detail.

Figure 5:
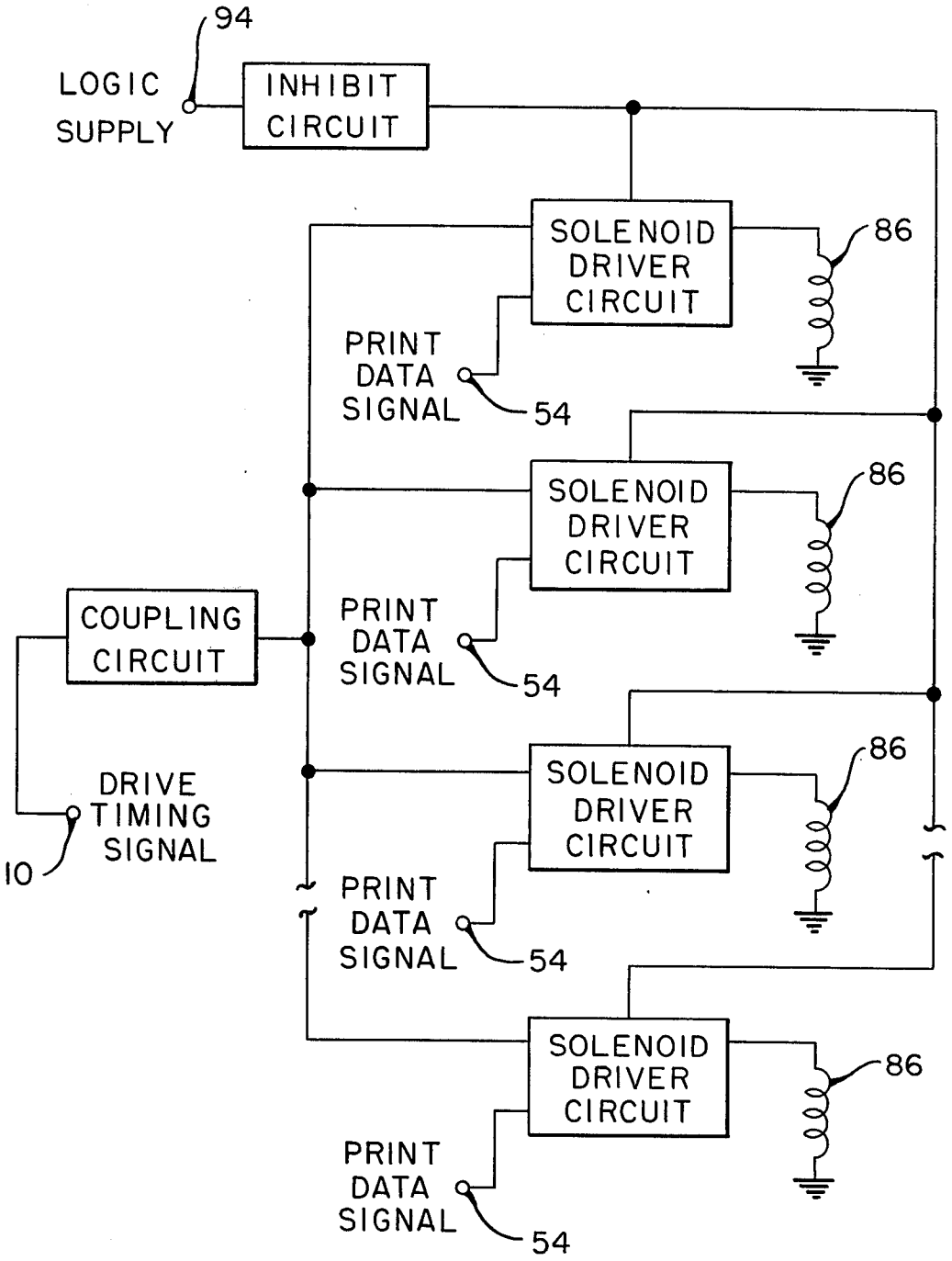
FIG. 5 is a block diagram showing the relationship of the coupling circuit and the inhibit circuit with a plurality of solenoid driver circuits.

As previously mentioned, and as shown in FIG. 5, a single coupling circuit of FIG. 1 is common to a plurality of the drive circuits of FIG. 2, the number of such circuits being equal to the number of solenoids (and print wires) in the wire matrix print head. The signal at terminal 42 is thus applied to the terminal 44 of each drive circuit.

When a particular solenoid 86 is to be energized to drive its print wire to effect printing, a print data signal, such as is shown in FIG. 4D, is applied to terminal 54 of the circuit of FIG. 2. This is a low-level signal of approximately zero volts (high level is approximately 5 volts), which in combination with a high-level signal on terminal 44, is effective to cause conduction in the transistor 48 in a constant current mode, if the inhibit line at terminal 66 is at its normal level of +28 volts, indicating no significant deviation of the 5-volt power supply from its proper level.

It should be noted that in the logic circuitry which supplies the print data signal to the terminal 54, gates should be used in which the outputs are open except during the generation of a print data signal so that the only positive current source which can turn on the transistor 48 is the signal at terminal 44, controlled by the transistor 40. This assures that all driver circuits can be turned off by the termination of conduction of transistor 40 in the coupling circuit of FIG. 1. The print data signal is referenced only to the +5-volt logic supply to minimize the sensitivity to ground line shifts between the circuit and other parts of the system. When not held at the low level, the signal may float, due to the open collector gates. FIG. 4E shows a typical signal on a non-selected terminal 54 when at least one other data input signal is in a low state. This input configuration yields good noise immunity.

The transistor 48 thus essentially performs a logic function in providing an output signal on its collector, by conduction, in response to a combination of a high-level drive time signal applied to the terminal 44 and a low-level print data signal (of substantially longer duration than the drive time signal) applied to the terminal 54.

Conduction of the transistor 48 causes the signal level on the base of the transistor 68 to drop. Conduction of the transistor 68 will result, provided that the inhibit line applied to the terminal 66 is at its normal level of +28 volts.

The terminal 66 is connected to the output terminal 126 of the inhibit circuit of FIG. 3, to which a potential of approximately +28 volts is applied so long as the logic power supply is at its normal potential level of +5 volts. This is determined in the circuit of FIG. 3 by applying the logic power supply potential to the terminal 94, from whence it is applied to the base of the transistor 102 through the switch 96 and the resistor 98.

The two emitter-coupled transistors 102 and 114 function as a differential amplifier by means of which the logic power supply potential at the terminal 94 is compared to a reference potential of +4.6 volts on the terminal 118 to the base of the transistor 114. So long as the potential on the base of the transistor 102 remains at +5 volts or thereabouts, the transistor 114 will be non-conducting and the transistor 102 will conduct, which will maintain the potential on the collector circuit of the transistor 102 at a sufficiently low level to bias the base of the transistor 122 so that said transistor will also conduct, thus maintaining a conducting path from the +28-volt terminal 112 through the transistor 122 to the inhibit output terminal 126, so that the potential level at that terminal will also be at substantially +28 volts.

If, however, the potential on the logic power supply terminal 94 falls below approximately 4.6 volts, the transistor 114 will commence to conduct and the transistor 102 will be cut off, which will raise the potential on its collector circuit to a level which will cause the transistor 122 to be cut off. In such a case, the potential at the output terminal 126 floats at a level near the power base reference potential, or ground, and as such cannot act as a current source for the circuit of FIG. 2.

The transistor 68 may be considered to perform a logic function in producing an output signal on its collector which is dependent upon the signal received from the transistor 48 and the signal level of the inhibit line applied to the terminal 66. The capacitor 74, connected between the base and collector circuits of the transistor 68, acts to slow the rate of voltage change during turn on and turn off, thus reducing the electrical noise generated by the circuit.

The signal on the collector of the transistor 68 is applied to the base of a first transistor of the Darlington device 72. The combination of a high-level drive timing signal, a low-level print data signal and a normal high-level inhibit line signal is effective to produce a high level signal input to the Darlington device 72 to cause conduction thereof, and to thereby initiate energization of the solenoid 86, over a path which extends from the +28-volt terminal 76 through the Darlington device 72, the resistor 82 and the solenoid 86, to base reference potential, or ground. The resistor 82 limits the current rise time, so that more print energy is available when the print wire makes contact with the record media to be printed upon, while limiting the coil power dissipation. Signal levels at nodes 78 and 84 (FIG. 2) are shown in FIGS. 4F and 4G respectively.

The logic ground of the circuit of FIG. 1 and the power ground of the circuit of FIG. 2 are separate and distinct grounds, but are connected at some point. However little or no current flows through this connection. Normally encountered offsets in potential between the power ground and the logic ground will have no effect on the driving circuitry, and loss of either ground or power supply will not cause the driving circuitry to be turned on.

Termination of the drive timing signal causes the transistor 48 to be turned off, which results in termination of conduction in the transistor 68 and the Darlington device 72. This interrupts the energizing current for the solenoid 86. Energy stored in the coil is dissipated by a current passing through the diode 88 to a negative 28-volt power supply connected to the terminal 90. In this way, the coil energy can be depleted rapidly without wasting the energy in a heat dissipating device. The energy delivered to the negative supply can be used by other concurrent functions of the device in which the drive circuit is used.

When the Darlington device 72 is conducting, it is very close to saturation and generates approximately one watt of power, depending upon the print density. Thus no heat sinking is required, which reduces the cost of the circuit.

Presented below are component values for the various circuit components included in the illustrated embodiment of FIGS. 1 and 2. It will, of course, be recognized that these values are merely exemplary, and that the selection of other component values to achieve desired circuit parameters would be well within the ability of one skilled in the art.

| | |
|---|---|
| 12 | No. 7400 TTL gate |
| 14 | 4.7 microfarads |
| 16 | 160 ohms |
| 20 | 2200 ohms |
| 24 | No. 2N3904 |
| 28 | No. IN914 |
| 30 | 6800 ohms |
| 32 | 430 ohms |
| 36 | 470 ohms |
| 40 | No. 2N3906 |
| 48 | No. 2N3904 |
| 50 | 750 ohms |
| 56 | 750 ohms |
| 62 | 470 ohms |
| 68 | No. 2N5400 |
| 72 | No. 2N6295 |
| 74 | 100 picofarads |

-continued

| | |
|---|---|
| 80 | 510 ohms |
| 82 | 5 ohms |
| 88 | No. IN4002 |
| 98 | 390 ohms |
| 102 | No. 2N3904 |
| 106 | 560 ohms |
| 110 | 1000 ohms |
| 114 | No. 2N3904 |
| 116 | 1000 ohms |
| 122 | No. 2N4355 |
| 128 | 0.01 microfarad |
| 132 | 100,000 ohms |
| 136 | 15,000 ohms. |

Although the invention has been described and illustrated in detail, it is to be clearly understood that the same is by way of illustration and example only, and is not to be taken by way of limitation, the spirit and scope of the invention being limited only by the terms of the appended claims.

What is claimed is:

1. An operating circuit comprising:

a plurality of individual solenoid driver circuits for controlling the energization of solenoids;

drive timing input means to which a drive timing signal may be applied;

means for coupling the drive timing input means to each of the plurality of individual solenoid driver circuits, said coupling means including means for limiting the time of energization of the solenoids;

data input means associated with each solenoid driver circuit to which a data signal may be applied; and inhibit means associated with each solenoid driver circuit and capable of inhibiting the operation of said circuit in response to a predetermined variation in the supply voltage for the coupling means;

whereby an individual solenoid driver circuit to which a data signal is applied may be operated at a time and for a duration determined by a drive timing signal so long as the supply voltage for the coupling means is within acceptable limits.

2. The operating circuit of claim 1 in which said means for limiting includes capacitive means.

3. An operating circuit comprising:

a plurality of individual solenoid driver circuits for controlling the energization of solenoids;

drive timing input means to which a drive timing signal may be applied;

means for coupling the drive timing input means to each of the plurality of individual solenoid driver circuits;

data input means associated with each solenoid driver circuit to which a data signal may be applied; and inhibit means associated with each solenoid driver circuit and capable of inhibiting the operation of said circuit in response to a predetermined variation in the supply voltage for the coupling means;

each individual solenoid driver circuit including first and second signal translating devices for enabling control of solenoid energization by the drive time signal, print data signal, and inhibit means;

whereby an individual solenoid driver circuit to which a data signal is applied may be operated at a time and for a duration determined by a drive timing signal so long as the supply voltage for the coupling means is within acceptable limits.

4. The operating circuit of claim 3 in which each individual solenoid driver circuit also includes a Darlington device for controlling the application of power for solenoid energization.

5. The operating circuit of claim 4 in which the Darlington device comprises a pair of NPN transistors.

6. The operating circuit of claim 3 in which each individual solenoid driver circuit also includes capacitive means associated with one of said signal translating devices to slow the rate of switching speed and thus minimize electrical interference from the circuit.

7. The operating circuit of claim 3 in which the first signal translating device is an NPN transistor, and the second signal translating device is a PNP transistor.

8. An operating circuit comprising:

a plurality of individual solenoid driver circuits for controlling the energization of solenoids;

drive timing input means to which a drive timing signal may be applied;

means for coupling the drive timing input means to each of the plurality of individual solenoid driver circuits, said coupling means including means to enable the shifting of supply voltage levels from the coupling means to the individual solenoid driver circuits;

data input means associated with each solenoid driver circuit to which a data signal may be applied; and inhibit means associated with each solenoid driver circuit and capable of inhibiting the operation of said circuit in response to a predetermined variation in the supply voltage for the coupling means;

whereby an individual solenoid driver circuit to which a data signal is applied may be operated at a time and for a duration determined by a drive timing signal so long as the supply voltage for the coupling means is within acceptable limits.

9. A drive circuit comprising:

a coupling circuit for coupling a drive timing signal to a first logic function means;

first logic function means for providing a first predetermined output signal in response to a predetermined combination of a drive time signal and a print data signal applied thereto;

second logic function means for providing a second predetermined output signal in response to a predetermined combination of said first predetermined output signal and an inhibit signal; and solenoid driving means for effecting the energization of a solenoid associated therewith in response to the application of said second predetermined output signal thereto;

said coupling circuit including means for limiting the time of energization of the solenoid;

whereby energization of a solenoid is effected by the combination of a drive timing signal and a print data signal in the absence of an inhibit signal.

10. The drive circuit of claim 9 in which said means for limiting includes capacitive means.

11. A drive circuit comprising:

a coupling circuit for coupling a drive timing signal to a first logic function means;

first logic function means for providing a first predetermined output signal in response to a predetermined combination of a drive time signal and a print data signal applied thereto;

second logic function means for providing a second predetermined output signal in response to a predetermined combination of said first predetermined output signal and an inhibit signal; and solenoid driving means for effecting the energization of a solenoid associated therewith in response to the application of said second predetermined output signal thereto;

said coupling circuit including means to enable the shifting of supply voltage levels from the coupling circuit to the level employed by the first and second logic function means and the solenoid driving means;

whereby energization of a solenoid is effected by the combination of a drive timing signal and a print data signal in the absence of an inhibit signal.

12. An electrical circuit for operating a solenoid comprising:

first input means for applying a drive timing signal to said circuit;

means coupled to said first input means for limiting the duration of the drive timing signal to prevent damage to said solenoid;

first signal translating means, the conduction of which is controlled by said drive timing signal;

second signal translating means, the conduction of which is controlled by the condition of the first signal translating means, so that its output is representative of the drive timing signal;

second input means for applying a print data signal to said circuit;

third signal translating means, to which the second input means and the output of the second signal translating means are applied, and having an output on which a signal representative of the combination of the print data signal and the drive timing signal appears;

fourth signal translating means coupled to the output of the third signal translating means;

power supply means for said fourth signal translating means, and including inhibit means capable of inhibiting said power supply means in the event of an unacceptable variation in the supply voltage for the second signal translating means; and fifth signal translating means controlled by the output of the fourth signal translating means and capable of controlling the application of power for solenoid energization;

whereby solenoid energization is effected by the combination of a drive timing signal and a print data signal in the absence of an inhibit condition.

13. The electrical circuit of claim 12 in which capacitive means is coupled between the input and the output of the fourth signal translating means to slow the rate of change of condition of said fourth signal translating means and thus minimize electrical interference emanating from the circuit.

14. The electrical circuit of claim 12, also including unidirectional conducting means for coupling the output of the fifth signal translating means to a power supply at the point of connection of said output to the solenoid to be driven, to enable rapid depletion of the energy remaining in the solenoid at the time of deenergization.

15. The electrical circuit of claim 14, in which the unidirectional conducting means is a diode.

16. The electrical circuit of claim 12 in which the fifth signal translating means is a Darlington device.

17. The electrical circuit of claim 12 in which the first and third signal translating means are NPN transistors and the second and fourth signal translating means are PNP transistors.

* * * * *